United States Patent [19]

Matsumoto et al.

[11] 4,430,409

[45] Feb. 7, 1984

[54] DEVELOPER FOR ELECTROPHOTOGRAPHY WITH WET PROCESS SILICIC ACID

[75] Inventors: Toru Matsumoto, Kita; Masanori Takenouchi, Urawa, both of Japan

[73] Assignee: Canon Kabushiki Kaisha, Tokyo, Japan

[21] Appl. No.: 518,317

[22] Filed: Jul. 29, 1983

Related U.S. Application Data

[63] Continuation of Ser. No. 314,438, Oct. 23, 1981, abandoned.

[30] Foreign Application Priority Data

| | | | |
|---|---|---|---|
| Oct. 31, 1980 | [JP] | Japan | 55-154462 |
| Nov. 4, 1980 | [JP] | Japan | 55-154938 |
| Aug. 8, 1981 | [JP] | Japan | 56-124227 |

[51] Int. Cl.[3] ..... G03G 9/10; G03G 9/14; G03G 9/08

[52] U.S. Cl. ..... 430/106.6; 430/110; 428/404; 428/407

[58] Field of Search ..... 430/109, 110, 106.6; 428/404, 407

[56] References Cited

U.S. PATENT DOCUMENTS

| | | | |
|---|---|---|---|
| 2,986,521 | 5/1961 | Wielicki | 430/109 X |
| 3,639,245 | 2/1972 | Nelson | 430/109 |
| 3,720,617 | 3/1973 | Chatterji et al. | 430/110 |
| 4,051,077 | 9/1977 | Fisher | 430/110 |

*Primary Examiner*—Roland E. Martin, Jr.

*Attorney, Agent, or Firm*—Fitzpatrick, Cella, Harper & Scinto

[57] ABSTRACT

As a developer for developing electrostatic images in electrophotography, electrostatic recording, electrostatic printing, etc., there is employed a developer containing a finely divided silicic acid which is a finely divided silicic acid synthesized by a wet process and has a pH value of 6 to 11 when suspended at a concentration of 4% by weight in distilled water and the developer can be positively charged strongly and uniformly to visualize the negative electrostatic images, giving a high quality image.

21 Claims, 1 Drawing Figure

DEVELOPER FOR ELECTROPHOTOGRAPHY WITH WET PROCESS SILICIC ACID

This application is a continuation of application Ser. No. 314,438 filed Oct. 23, 1981, now abandoned.

BACKGROUND OF THE INVENTION

1. Field of the Invention

This invention relates to a developer for developing electrostatic images in electrophotography, electrostatic recording, electrostatic printing, and the like. More particularly, the present invention relates to a developer for electrophotography which can be positively charged strongly and uniformly to visualize the negative electrostatic images, thus giving high quality images, in the method of direct or indirect electrophotographic developing method, and also to a developing method by the use thereof.

2. Description of the Prior Art

In the prior art, there have been known a number of electrophotographic processes, as disclosed in U.S. Pat. No. 2,297,691 or others. In general, a photoconductive material is utilized, electric latent images are formed by various means on a photosensitive member, then said latent images are developed by use of a developing powder (hereinafter referred to as toner), which toner image may, if necessary, be copied on a copying material such as paper, and thereafter fixing of the images effected by heat, pressure or a solvent vapor to give a copied product. When having a step for copying toner image, there is usually provided a step for removing residual toner on the photosensitive member.

As the method for visualization of electric latent images by use of toner, there have been known the magnetic brush method as disclosed in U.S. Pat. No. 2,874,063, the cascade method as disclosed in U.S. Pat. No. 2,618,522, the powder cloud method as disclosed in U.S. Pat. No. 2,221,776, the method using conductive magnetic toner as disclosed in U.S. Pat. No. 3,909,258 and the method using various insulating magnetic toners as disclosed in Japanese Patent Publication No. 9475/1966.

As the toner to be applied for these developing methods, there have been used in the prior art fine powders comprising dyes or pigments dispersed in a natural or synthetic resin. For example, a dispersion having coloring agents dispersed in a binder resin such as polystyrene is pulverized into particles with sizes of 1 to 30$\mu$ for use as a toner. As a magnetic toner, there is employed a toner in which magnetic particles such as of magnetite are incorporated. In case of the system in which so called two-component developer is used, toner is generally used as a mixture with carrier particles such as glass beads, iron powders, etc.

As the positive charge controlling agents to be used for such a dry system developing, there may generally be included, for example, amino compounds, quaternary ammonium compounds and organic dyes, especially basic dyes and salts thereof. Ordinary positive charge controlling agents are benzyldimethyl-hexadecyl ammonium chloride, decyl-trimethyl ammonium chloride, nigrosine base, nigrosine hydrochloride, safranine $\gamma$, crystal violet, and the like. In particular, nigrosine base and nigrosine hydrocloride are frequently used as positive charge controlling agents. These materials are generally added to thermoplastic resins, dispersed by melting with heating and the mixture is pulverized, followed by, if necessary, adjustment of the particle sizes, before use.

However, the dyes as these charge controlling agents have complicated structures with various properties and are poor in stability. They may also be decomposed or denatured due to decomposition during hot kneading, mechanical shock, friction, changes in temperature and humidity conditions, etc., thereby causing the phenomenon of lowered charge controllability.

Accordingly, when development is performed by use of a toner containing these dyes as charge controlling agent in a copying machine, the dyes are decomposed or deteriorate as the increase of repeated copying times to cause deterioration of toner during prolonged usage.

The dyes as these charge controlling agents can very difficultly be uniformly dispersed in a thermoplastic resin, and hence the toner particles obtained by pulverization have the vital defect of having different quantities of triboelectrification. On account of such a detect, there have conventionally been performed various methods for effecting more uniform dispersion of these dyes in the resin. For example, basic nigrosine dye is used as a salt with a higher fatty acid for improvement of compatibility with thermoplastic resins. But unaltered fatty acid or a dispersed product of the salt will frequently be exposed on the toner surface to cause contamination of carriers or the support for toner, whereby lowering of fluidity of toner, fogging or lowering of image density may be caused. Alternatively, there is adopted the method for improvement of dispersion of these dyes in the resins to crush and mix mechanically the dye powders with resin powders before hot melt kneading. But the inherent poor dispersibility cannot be avoided, and there has not yet been obtained actually sufficient uniformness of charging.

Most of the positive charge controlling dyes are hydrophilic and, due to poor dispersibility into the resins, dyes may be exposed on the surface of toner when pulverized after melt kneading. During usage of said toner under highly humid conditions, hydrophilic property of these dyes makes it difficult to obtain good images.

As described above, in the case of dyes of prior art having positive charge controlling characteristic, there may be caused variance in charge quantities generated on toner particles between toner particles, between toner and carrier or between toner and toner support such as a sleeve, whereby such troubles as developing fog, toner scattering and carrier contamination will occur. These undesirable phenomena will appear more conspicuously when a large number of copying papers are piled, to give a result unsuitable for a copying machine.

Under highly humid conditions, the transferring efficiency of toner image is also markedly lowered and therefore such a toner is no longer useful. Even under normal temperature and normal humidity, when said toner is stored for a long time, toner agglomeration may occur on account of instability of the positive charge controlling dye employed, thus becoming frequently impossible for use.

On the other hand, as the method for fixing toner images on support, there have been invented various fixing techniques in the past by utilization of heat, pressure and solvent. Among them, fixing system by pressurization has advantages of requiring a little amount of energy and dispensing with the waiting time for copying.

According to a pressure fixing system, it is required to use a toner material which is less tacky but greater in cohesive force to have a small frictional coefficient. As such a toner material, ethylenic olefin polymers, typically polyethylene, are well known in the art. At present, however, it is difficult to obtain a toner for developing negative latent image with the use of polyethylene. In the prior art, nigrosine base and nigrosine hydrochloride are frequently used as positive charge controller. While these can act comparatively effectively on toner materials to be used for thermal fixing system, typically polystyrene, to make the toner positively chargeable, they are not effective at all for ethylenic olefin polymers.

To explain in further detail about the developing method as mentioned above, the developing methods may be classified broadly into dry system developing method and wet system developing method. The former is further differentiated into two categories, one being a method using a two-component system developer and the other a method using a one-component system developer. The methods belonging to the two-component system developing method include various methods using various carriers for conveying toner, such as the magnet brush method using iron powder carrier, the cascade method using beads carrier and the fur brush method using fur.

On the other hand, those belonging to the one-component systym method, there are the powder cloud method in which toner particles are used in an atomized state, the contact developing method (or toner developing) in which development is performed by contacting toner particles directly with the electrostatic latent image surface, the jumping method in which toner particles are not contacted directly with the electrostatic latent image surface but toner particles are charged and permitted to flight through the electric field possessed by the electrostatic latent image toward said latent image, and the magne-dry method in which development is performed by contacting magnetic conductive toners on electrostatic latent image surface. According to the two-component system method, a mixed developer of carrier particles and toner particles is necessarily used, and toner particles are consumed in an amount by far greater than carrier particles in the usual progress of development, whereby the mixing ratio of both particles is changed to cause variations in density of images of interest. Another disadvantage inherent in this method is that carrier particles difficultly consumed will be deteriorated on prolonged usage to lower the image quality.

On the other hand, according to the one-component developing method such as the magne-dry method using magnetic toner and the contact developing method using no magnetic toner, toner is contacted on all the surface to be developed, irrespectively of the image portion or the non-image portion. For this reason, there is the problem that toner may be attached also on the non-image portion to cause easily contamination of so called ground fogging. (This fogging contamination was also the disadvantage similarly caused in the two-component system developing method.) Also, in the powder cloud method, attachment of powdery toner particles on the non-image portion cannot be avoided and thus said method has also the disadvantage of being not free from ground fogging.

Further, as the so called jumping method belonging to one-component system developing method, there is known a method in which a support such as a sheet is coated unformly with a toner and faced with a surface holding electrostatic charges at a small gap, and the toner is attracted from the toner support by the charges possessed by the electrostatic image to be attached onto the electrostatic image holding surface (see U.S. Pat. No. 2,839,400).

According to this method, there is the advantage that no toner is attracted onto the non-image portion devoid of electrostatic charges. Still another advantage is that the aforesaid fogging will difficultly occur because toner is not contacted with non-image portion. Further, since no carrier particle is used, there is neither change of the mixing ratio as mentioned above nor deterioration of carrier particles.

However, according to this method, in which electric field is given for attachment of toner previously on a toner supporting sheet, it is difficult to apply uniformly and thinly toner onto the support, and therefore coating irregularity is liable to be formed. As another disadvantage, when the toner layer coated is faced toward the electrostatic image, uniform release of toner toward the electrostatic image is also difficult.

In this respect, the developing device as proposed in Japanese Laid-open Patent Application No. 43027/1979 and No. 18656/1980, having magnetic toner and movable toner support (sleeve roller) and static magnet provided internally of said support, in which there is arranged a member for regulating toner thickness of a magnetic material near the outer surface of the sleeve roller so as to face the magnetic pole of said magnet, enables uniform and thin coating of toner on the outer surface of the sleeve roller. Such device has overcome the drawbacks as mentioned above and may be appreciated as an electrostatic image developing device which can give highly faithful and stable images.

The present inventors have found the problem that image quality is lowered by lowering of image density when copying is continued repeatedly by using a jumping developer known in the art, especially under the conditions of high temperature or high humidity. As the result of studies made on this point, it has been found that one of the causes for such a phenomenon resides in stability and reliability of the charge controlling component, on account of which attachment of developing powders onto said sleeve and transfer of developing powders from the sleeve are changed.

SUMMARY OF THE INVENTION

An object of the present invention is to provide a developer for electrophotography, which has overcome various problems involved in positively charging toners of prior art and can be strongly positively charged uniformly to visualize negative electrostatic images, thus giving high quality images.

Another object of the present invention is to provide a developer for electrophotography for developing negative latent images, in which there is employed an ethylenic olefin polymer which is a material suitable for pressure fixing system.

Still another object of the present invention is to provide a developer, by use of which quantities of triboelectrification can be stable and uniform between toner particles, or between toner and carrier, or between toner and toner support as in case of one component develper, without fogging, toner scattering or agglomeration of toners, and a large number of durable copies can be obtained.

Further, still another object of the present invention is to provide a developer, which can reproduce stable images without being affected by changes in temperature and humidity, especially a developer with a great transferring efficiency at the time of high humidity.

Still another object of the present invention is to provide a developing method excellent in durability such as continuous use characteristics.

Still another object of the present invention is to provide a developing method which is stable even under environmental changes such as high temperature and high humidity.

According to one aspect of the present invention, there is provided a developer for electrophotography, comprising a finely divided silicic acid which is prepared by a wet process and has a pH value of 6 to 11 when suspended at a concentration of 4% by weight in distilled water.

According to another aspect of the present invention, there is provided a developing method, which comprises arranging an electrostatic image holding member which bears an electrostatic image on its surface and a developer holding member which carries an insulating developer on its surface at the developing portion at a predetermined gap therebetween, being carried said developer containing a finely divided silicic acid synthesized according to a wet process on said developer holding member, and developing by transferring said developer to said electrostatic image holding member at said developing portion.

DESCRIPTION OF PREFERRED EMBODIMENTS

Figure 1:
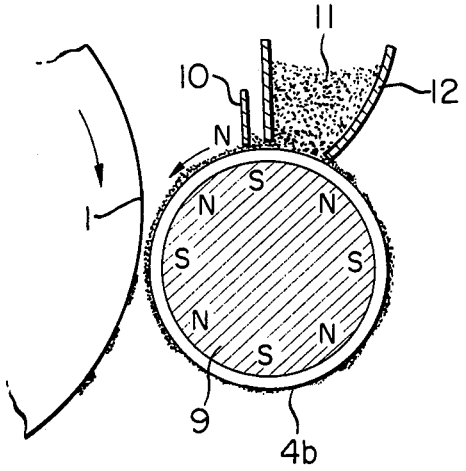
FIG. 1 shows a sectional view indicating one embodiment of the developing step to be applied to the present invention.

It is well known in the art to add a finely divided silica called under the name of colloidal silica (e.g. Aerozil 200, R 972, produced by Nippon Aerozil Co., Ltd.) to a developer. However, such silica was not suitable for visualization of negative electrostatic images, since even a toner containing a dye having positive charge controlling capacity is changed to negative in chargeable characteristic by addition of such silica. As the result of studies made by the present inventors about the above phenomenon, it has been found that a silica of prior art prepared according to a dry process will decrease the charges of positively chargeable toner or reverse the polarity thereof. Further, investigations have been continued in detail in order to obtain a toner exhibiting stably high positive charging property. As a consequence, it has been found that a finely divided silicic acid prepared according to the wet process can effectively added.

As the method for preparation of the finely divided silicic acid to be used in the present invention according to a wet process, there may be employed various methods known in the art. For example, decomposition of sodium silicate is represented by the general reaction scheme shown below (the reaction scheme is hereinafter omitted):

$$Na_2O.xSiO_2+HCl+H_2O \rightarrow SiO_2.nH_2O+NaCl$$

Otherwise, there are a process in which sodium silicate is decomposed with ammonium salts or an alkali salts; a process in which sodium silicate is converted to an alkaline earth metal silicate, followed by decomposition with an acid to silicicacid; a process in which a solution of sodium silicate is treated with an ion-exchange to silicic acid; and a process in which natural silicic acid or silicate is utilized.

The finely divided silicic acid to be used in the present invention is inclusive, in addition to anhydrous silicon dioxide (silica), of silicates such as aluminum silicate, sodium silicate, potassium silicate, magnesium silicate and zinc silicate. Its particle size, as the average primary particle size, is desired to be within the range of from 0.01 to 2$\mu$. The quantity of such a finely divided silicic acid applied, in case of a toner for thermal fixation, is 0.01 to 20% by weight based on the developer to exhibit its effect, particularly preferably 0.1 to 3% to exhibit positively chargeable characteristics with excellent stability. To mention about a preferable mode of addition, it is preferred that 0.01 to 3% by weight based on the developer of a finely divided silicic acid may be adhered on the surface of toner particles.

Commercially available finely divided silicic acid prepared according to the wet process, which can be used in the present invention, are sold under the trade names as shown below:

| | |
|---|---|
| Carplex | Shionogi & Co., Ltd. |
| Nipsil | Nippon Silica Co., Ltd. |
| Tokusil, Finesil | Tokyuama Soda Co., Ltd. |
| Vitasil | Taki Fertilizer Manufacturing Co., Ltd. |
| Silton, Silnex | Mizusawa Chemical Co., Ltd. |
| Starsil | Kamishima Chemical Co., Ltd. |
| Himezil | Ehime Pharmaceutical Co., Ltd. |
| Siloid | Fuji Devidson Chemical Co., Ltd. |
| Hi-sil | Pittsburgh Plate Glass Co. |
| Durosil | Fuellstoff-Gesellschaft |
| Ultrasil | Marquart (Fuellstoff-Gellschaft Marquart) |
| Manosil | Hardman and Holden |
| Hoesch | Chemische Fabrik Hoesch K-G |
| Sil-Stone | Stoner Rubber Co. |
| Nalco | Nalco Chem. Co. |
| Quso | Philadelphia Quartz Co. |
| Imsil | Illinois Minerals Co. |
| Calcium Silikat | Chemicsche Fabrik Hoesch K-G |
| Calsil | Fuelstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabriken Bayer, A.G. |
| Tufknit | Durham Chemical, Ltd. |
| Silmos | Shiraishi Kogyo Co., Ltd. |
| Starlex | Kamishima Chemical Co., Ltd. |
| Frucosil | Taki Fertilizer Manufacturing Co., Ltd. |

These silicic acids are prepared to have an average primary particles size in the range of from 0.01 to 2$\mu$ to be provided for use.

In the present invention, as mentioned above, a finely divided silicic acid synthesized according to a wet process is used to exhibit the effect. Among such finely divided silicic acids prepared according to the wet process, those containing at least 85% by weight of $SiO_2$ are particularly preferred.

The finely divided silicic acids prepared according to the wet process to be used in the present invention, having stably strong positively chargeable characteristic, as different from the silica of a dry process conventionally used in toners of prior art, have micro-pores in its inner structure and also contains a large quantity of water molecules bonded through Van der Waals force to silanol groups on the surface of said pores. The water content in such an inner structure of finely divided silicic acid exists relatively stably without influence from environmental changes, as different from the water adsorbed on the surface of silica prepared according to the dry process. The stable positively chargeable characteristic exhibited by the toner, containing as a specific feature of the invention a finely divided silicic acid synthesized according to the wet process, may be ascribed to such a stable water content in its inner structure as described above. The water content in the inner structure of finely divided silicic acid, which may be represented in terms of the percentage of weight loss when heated at, for example, 900° C. for 2 hours (ignition loss), is preferred to be 0.1 to 10% by weight, more preferably 0.3 to 6% by weight, in terms of such ignition loss.

As the result of further investigations about finely divided silicic acid synthesized according to a wet process, which enables stable and strong positive charging of toners, it has also been found preferable to use a finely divided silicic acid exhibiting a pH value of 6 to 11, more preferably 7 to 9, when said finely divided silicic acid is suspended at a concentration of 4% by weight in water. This seems to be due to the influence by various elements contained in starting materials for preparation of finely divided silicic acid or in treating agents used during the synthetic step. In particular, incorporation of alkali metal elements may be considered to give a preferable effect. Among them, it has been found that a silicic acid containing an appropriate amount of sodium ions give especially significant effects by experiments. For the purpose of stable positive charging of toners, it is particularly preferred to use a silicic acid, which satisfies the above pH conditions and contains an appropriate amount of sodium ions. The preferable sodium content which can give the above ph values is 0.01 to 10% by weight as calculated on $Na_2O$. This may be considered to be due to the effect of the interaction between sodium ions, which are incorporated in $SiO_2$ lattices in the vicinity of the surface of finely divided silicic acid added to toners or adhered on the surface of finely divided silicic acid, and water contained internally of said finely divided silicic acid or absorbed on its surface, on formation of stable positive charges.

Thus, among the finely divided silicic acids synthesized according to a wet process to be used in the present invention, it is preferred to use one having a pH of 6 to 11 in an aqueous suspension, especially containing sodium in an amount of 0.01 to 10% (sodium content being 0.1 to 2.0% to maintain a particularly preferred pH in an aqueous dispersion) as calculated in terms of $Na_2O$.

In the following, there are enumerated particularly preferable examples of finely divided silicic acids synthesized according to wet processes to be used in the present invention, by which the scope of the present invention is not of course limited at all.

TABLE 1

| Trade name, | Grade | $SiO_2$ % | Ignition loss % (900° C. 2 hours) | pH value 4% suspension | $Na_2O$ % |
|---|---|---|---|---|---|
| Nipsil (Nippon Silica) | VN3 | 93.7 | 4.9 | 6.0 | 0.34 |
| | AQ | 93.3 | 5.0 | 6.0 | 0.58 |
| | LP | 93.4 | 5.8 | 6.0 | 0.31 |

TABLE 1-continued

| Trade name, | Grade | $SiO_2$ % | Ignition loss % (900° C. 2 hours) | pH value 4% suspension | $Na_2O$ % |
|---|---|---|---|---|---|
| | NS | 94.7 | 3.8 | 6.0 | 0.47 |
| | ER | 94.7 | 4.0 | 7~8.5 | 0.55 |
| | NA | 92.9 | 4.6 | 10~11 | 1.69 |
| | E.200A | 94.2 | 4.5 | 6~7 | 0.29 |
| Finesil (Tokuyama Soda Co.) | E-50 | ≧94 | 4.5 | 6.5 | |
| | T-32 | ≧94 | 4.5 | 6.5 | |
| Hi-Sil.233 (Pittsburgh Plate Glass Co.) | | 94 | 5.3 | 7.0 | 1.7 |
| Siloid (Fuji-Devidson Chemical Co.) | 79 | 99.4 | 5.0 | 7.5 | 0.10 |
| | 161 | 99.4 | 16.0 | 7.5 | 0.10 |
| | 244 | 99.4 | 6.5 | 7.5 | 0.10 |
| Imsil (Illinois Min., Co.) | A-10 | 99.5 | 0.3 | 7.0 | 0.1 |
| | A-108 | 99.5 | 0.3 | 7.0 | 0.1 |
| | H | " | " | " | 0.1 |
| | S | " | " | " | 0.1 |
| | K | " | " | " | 0.1 |
| Carplex (Shionogi & Co., Ltd.) | #1120 | 86~92 | 4.5~6.5 | 10.4~10.9 | 0.1 |
| | #67 | 90~96 | 4.5~6.5 | 7.0~8.0 | 0.1 |
| Vitasil (Taki Fertilizer Manufacturing Co.) | #220 | 85 | 4~7 | 8.0~9.0 | 2.0 |
| | #550 | 85 | 4~7 | 6.5~7.5 | 2.0 |
| | #1500 | 85 | 4~7 | 6.5~7.5 | 1.0 |
| | #1200 | 85 | 4~7 | 10.0~11.0 | 2.0 |
| QUSO (Philadelphia Quartz Comp.) | G30 | 97 | 11 | 8.5 | 1.0 |
| | G32 | 97 | 11 | 8.5 | 1.0 |

These finely divided silicic acid synthesized according to wet processes may also be treated their surfaces with an organic compound.

As the binder resin to be used for the toner according to the present invention, there may be included homopolymers of styrene and its derivatives such as polystyrene, poly-p-chlorostyrene, polyvinyltoluene, and the like; styrene type copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymer, and the like; polymethyl-methacrylate, polybutylmethacrylate, polyvinyl chloride, polyvinyl acetate, polyethylene, polypropylene, polyesters, polyurethanes, polyamides, epoxy resins, polyvinyl butyral, polyacrylic acid resins, rosin, modified rosin, terpene resin, phenolic resins, aliphatic or alicyclic hydrocarbon resins, aromatic petroleum resins, chlorinated paraffins, paraffin sax, and so on. These binder resins may be used either as a single species or a mixture of two or more species.

When a pressure fixing toner is to be prepared, it is preferred to use an ethylenic olefin polymer. The ethylenic olefin polymer refers herein to a homopolymer of an ethylenic olefin such as ethylene, propylene, butylene etc. or a copolymer principally composed of such monomers, as exemplified by polyethylene, polypropylene, ethylene-ethyl acrylate copolymer, ethylene-vinyl acetate copolymer, ethylene-propylene copolymer, etylene-butyl acrylate copolymer, etc. Among them, polyethylene or an ethylene copolymer principally composed of ethylene having a melt viscosity of 10 to $10^4$ centipoise at 140° C.

The ethylenic olefin polymers according to the present invention are so called sharp melt type binder substances and therefore it is difficult to maintain the melt viscosity of binder substances at a high value during dispersion of coloring agents, whereby dispersibility of a coloring agents is liable to be worsened. In this respect, the finely divided silicic acid to be admixed in the toner according to the present invention can very effectively maintain the melt viscosity at a high value to improve dispersibility of coloring agents.

The developer to be used, when ethylenic olefin polymers are used, may be produced in various well-known ways. But it is preferred to produce such developer by melting and kneading ethylenic olefin polymers, coloring agents, a finely divided silicic acid synthesized according to a wet process and, if necessary, the aforesaid binder or additives, granulating the resultant mixture according to a known method, followed by classification, to provide fine particles of about 1 to 35μ, and further mixing the fine particles with a finely divided silicic acid synthesized according to a wet process. In carrying out this procedure, the aforesaid fine particles may preferably contain 10% by weight or more, more preferably 30% by weight or more, particularly 60% by weight or more of an ethylenic olefin polymer and 5 to 40% by weight, more preferably 7 to 35% by weight, particularly 10 to 30% by weight of a finely divided silicic acid synthesized according to a wet process, and said fine particles are then mixed with preferably 0.1 to 10% by weight, more preferably 0.3 to 7% by weight, particularly 0.5 to 5% by weight of a finely divided silicic acid synthesized according to a wet process.

As the coloring agent to be used for the toner of the present invention, it is possible to employ carbon black, iron black, etc. well known in the art, and all of the dyes conventionally used as positive charge controlling agents may be used in combination with the finely divided silicic acid synthesized according to a wet process to be used in the present invention. Such dyes may include, for example, benzyldimethyl-hexadecylammonium chloride, decyl-trimethylammonium chloride, nigrosine base, nigrosine hydrochloride, safranine γ, crystal violet, and the like.

There may also be incorporated magnetic powders in the toner of the present invention, in order to use the present toner as a magnetic toner. As such magnetic powders, there may be employed substances which are magnetized when placed in a magnetic field, including powders of strongly magnetic metals such as iron, cobalt, nickel, or the like, or alloys or compounts such as magnetite, hematite, ferrite, or the like. These magnetic powders may be contained in an amount of 15 to 70% by weight based on the toner.

Further, the toner of the present invention may be mixed, if desired, with carrier particles such as glass beads, nickel powders, ferrite powders, and the like to be used as a developer for electrostatic latent images.

The first specific feature of the thus constituted positively chargeable developer, since it employs the aforesaid finely divided silicic acid synthesized according to a wet process as charge controller, is that there is substantially no variance of quantity of triboelectrification among toner particles, especially when used as a developer for electrophotography. Moreover, due to greater charge bearing capacity, there is no such phenomenon as development fogging, toner scattering or toner agglomeration, which cannot be avoided in the prior art. Consequently, there is no deterioration of toner after prolonged usage caused by such drawbacks, whereby there can be obtained high quality images for a long time. There are also some actually important characteristics. One of them is a surprising characteristic that there is substantially no change in charge bearing capacity by environmental changes such as temperature, humidity or others, especially that the copying efficiency at the time of high humidity is substantially the same as at the time of normal humidity, because there is employed a finely divided silicic acid in which water exists stably adsorbed on silanol groups on the surface of micropores in its inner structure.

The other feature is that the finely divided silicic acid to be used in the present invention can be used in combination with any kind of resin, as contrasted to the pigments or dyes of piror art for which a specific class of resins must be selected due to poor dispersibility of such pigments or dyes, whereby it is possible to adopt a widely applicable toner constitution. For example, the toner of the present invention may be used for, in addition to a toner for thermal fixation, a pressure fixing toner or a capsule toner.

The developer according to the present invention may be applicable for various developing methods. For example, there are the magnetic brush developing method, the cascade developing method, the method in which electroconductive magnetic toner is used as disclosed in U.S. Pat. No. 3,909,258, the method in which high resistance magnetic toner is used as disclosed in Japanese Laid-open patent application No. 31136/1978, the methods as disclosed in Japanese Laid-open patent application Nos. 42141/1979, 18656/1980, and 43027/1979, the fur brush developing method, the powder cloud method, the impression developing method, etc. In particular, it is suitable to employ the method as disclosed in said Japanese Laid-open patent application Nos. 42141/1979, 18656/1980, and the like.

Referring now to the drawing, the developing step disclosed in said Patent Applications is to be explained. FIG. 1 shows a sectional view of one embodiment. In FIG. 1, the electrostatic image holding member 1 moves in the direction of the arrowhead. The non-magnetic cylinder **4*b*, which is the developer holding member, rotates so as to be progressed in the same direction as the surface of the electrostatic image holding member. Internally of the non-magnetic cylinder 4*b*, there is arranged a multi-polar permanent magnet 9 so that it may not be rotated. One-component system insulating magnetic developer 11 fed from the developer vessel 12 is coated on the surface of the magnetic cylinder, and through friction between the cylindrical surface and toner particles, charges with the polarity opposite to those of electrostatic image are imparted to toner particles. Further, the doctor blade 10 of iron is placed close to (at a gap of 50μ to 500μ) the surface of the cylinder surface at a position facing the position of one magnetic pole (S pole as indicated in the drawing) of the multi-polar permanent magnet 9, in order to regulate thinly (30μ to 300μ) and uniformly the thickness of the toner layer. By controlling the rotating speed of this cylinder 4b, the surface layer velocity and preferably the internal velocity is made substantially equal or approximate to that of the electrostatic image holding surface. The doctor blade 10** may also be made of permanent magnet in place of iron to form a counter-magnetic pole. It is also possible to apply an alternate current bias at the developing portion between the developer holding member and the electrostatic image holding surface. Such alternate current bias may have a frequency of 200 to 4000 $H_z$ and a $V_{pp}$ of 500 to 3000 V.

As described above, in this developing step, a non-magnetic cylinder 4b including a multi-polar permanent magnet 9 therein was used for the purpose of holding stably the one-component magnetic developer on the developer carrier. A doctor blade 10 made of a thin plate of magnetic material or a permanent magnet was also arranged nearby the surface of the cylinder 4b in order to form thinly and uniformly the developer layer. When such doctor blade of magnetic material is used, a counter-magnetic pole is formed between the magnetic pole enclosed within the developer carrier and the blade, whereby the toner particle chain is forcibly raised between the doctor blade and the developer carrier to enable advantageously regulation of other portions on the developer holding member, for example, the developer layer at the developing portion facing the electrostatic image surface, to a thin thickness. Further, by enforcing the developer under such motion, the developer layer can be made more uniform and thus formation of a thin and uniform layer not realized with a non-magnetic doctor blade can be accomplished. Moreover, since the gap between the doctor blade and the sleeve can be set comparatively wider, there is also the effect of preventing breaking or agglomeration of toner particles. Transfer of toner particles at the developing portion to the side of electrostatic images may be effected by attracting action of electrostatic images or the action of alternate current bias.

Having described above about the basic constitution and the specific features of the present invention, the process of the present invention is illustrated below with reference to the Examples, by which the embodiments of the present invention are not limited at all. In Examples, parts are parts by weight.

Example 1

| | |
|---|---|
| Picolastic D-150 (polystyrene resin produced by Esso Petroleum Chemical Co.) | 100 parts |
| Peerless 155 (carbon black produced by Columbia Carbon Co.) | 5 parts |
| Methylene blue chloride | 5 parts |

After blending the above materials thoroughly in a blender, the resultant blend was kneaded on a two-roll mill heated at 150° C. After the kneaded mass was left to cool, followed by granulation on a cutter mill, the resulting granules were pulverized by means of a pulverizer using a jet air stream and further subjected to classification by means of a wind force classifier to obtain fine particles of an average diameter of 10 to 20μ. To this toner, 1.0 part by weight of Hi-Sil 233 (produced by Pittsburgh Plate Glass Co.) was added and mixed in a Henschel mixer. To 5 parts of this mixture, there were added 100 parts of iron powder carriers to prepare a developer.

Then, according to a conventional electrophotographic process, negative electrostatic images were formed on a photosensitive element of zinc oxide and toner images were formed by powder development according to the magnetic brush method using the above developer, followed by transferring of the toner image on a plane paper to be thermally fixed thereon The resulting copied images had a sufficiently high density of 1.5 free from fog at all, being good images with high resolution. Copied images were prepared continuously using the above developer for examination of durability. The copied image after copying 20000 sheets was found to be comparable in all respects to the image at the initial stage. When the environmental conditions were changed to 35° C. and relative humidity of 85%, the image density was also as good as 1.4, without fog, and clears image were obtained.

Comparative example 1

A developer was prepared similarly to in Example 1, except that no Hi-Sil 233 was added and development of negative electrostatic images on the zinc oxide photosensitive element was carried out by the use of this developer, followed by copying on a plane paper and thermal fixation. The resulting images were low in density, namely 0.73, with much fogging and not clear. When continuous durability test was conducted with the use of this developer, the image density was lowered to 0.50 after copying 2000 sheets, fogging being also increased. Under the conditions of 35° C. and humidity of 85%, even the images at the initial stage had an image density as low as 0.45.

Example 2

| | |
|---|---|
| Epikote #1007 (epoxy resin produced by Shell Chemical Co.) | 100 parts |
| Morgan A (carbon black produced by Cabot Co.) | 10 parts |
| Spirit Black AB2 | 2 parts |

The above materials were formulated to prepare a toner according to the procedure as described in Example 1. To 10 parts of a mixture of this toner with 1.2 parts by weight of Imusil A.108 (produced by Illinois Mineral Co.), there were added 100 parts of iron powder with a particle size of 50–100μ to prepare a magnetic brush developer. Using this developer, copied fixed image was prepared similarly to in Example 1 to obtain images having high image density of 1.35 without fog at all, and being excellent in gradation and resolution. The durability was also good, namely the density of copied image after copying 20000 sheets remained to be 1.35 without fog at all. Even under conditions of 35° C. and a humidity of 85%, the density was as high as 1.2 and the transferring efficiency was excellently 80%.

Comparative example 2

A developer was prepared similarly to in Example 2 except that no Imusil A-108 was added, and development, transferring and fixation were conducted by means of the same device as used in Example 2. As the result, the image density was as low as 0.63 with much fogging and only unclear images were obtained. Under the conditions of 35° C. and a humidity of 85%, the image density was extremely low as 0.32 to give only an impractical image.

Example 3

| | |
|---|---|
| Polymist A-12 (polyethylene produced by Allied Chemical Co.) | 100 parts |
| Solvent Black 3 | 5 parts |
| Carplex #1120 (wet process silica, produced by Shionogi & Co., Ltd.) | 15 parts |

The above materials were well blended by a blender and then kneaded on a two-roll mill heated at 150° C., followed by pulverization and classification similarly as in Example 1, to prepare fine powders of an average particle size of 10 to 20μ. Development and transferring were carried out in the same manner as in Example 1, using these toner powder, and pressure fixation effected with a pressure roller to obtain images. The image density was high as 1.28, and it was sufficiently high as 1.10 even after 10000 sheets of copied images, without fog, exhibiting excellent resolution and gradation.

Examples 4 to 7

Various toners having the compositions as shown in the following Table were prepared. Good results were obtained in all of these cases.

| Example No. | Binder resin | Dye | Finely divided silicic acid | Initial image density | Density after 20000 sheets | Density at 35° C. 85% |
|---|---|---|---|---|---|---|
| 4 | Polyethylene 130 (Hoechst AG) 100 parts<br>Paraffin wax 155 (Nippon Seiro) 50 parts | Sumizol black AR 5 parts | Vitasil #220 (Taki Fertilizer Mfg. Co.) 1.0 part | 1.42 | 1.25 | 1.20 |
| 5 | Epotote D 14 (Toto Chemical Co.) 100 parts | Oil Black HBB 2 parts | QUSO G 30 (Philadelphia Quartz Co.) 1.2 parts | 1.37 | 1.30 | 1.0 |
| 6 | Priolite AC-L (Goodyear Chemicals) 100 parts | Basic Violet 2 parts | Silmos (Shiraishi Kogyo Co.) 0.3 parts | 1.30 | 1.30 | 1.15 |
| 7 | Hitanol (Hitachi Chemical Co.) 100 parts | Pigment Black 1 5 parts | Imusil H (Illinois Min. Co.) 1.0 part | 1.46 | 1.38 | 1.15 |

Example 8

A mixture comprising 100 parts of zinc oxide, 20 parts of styrene-butadiene copolymer, 40 parts of n-butyl methacrylate, 120 parts of toluene and 4 parts of 1% methanolic solution of Rose Bengal was dispersed and mixed in a ball mill for 6 hours. The mixture was coated by a wire bar on an aluminum plate with a thickness of 0.05 mm to a dried coating thickness of 40μ and the solvent was evaporated with hot air to prepare a zinc oxide binder system photosensitive member, which was then formed into a drum-like shape. The entire surface of this photosensitive member was uniformly charged by corona discharge of −6 KV, and thereafter irradiation of original image was effected thereon to form an electrostatic latent image.

The developer support was a cylindrical sleeve made of stainless steel with an outer diameter of 50 mm. The flux density on the sleeve surface was 700 Gauss and the gap between the ear-cutting blade and the sleeve surface 0.2 mm. This sleeve-rotating magnet-fixed (the sleeve circumferential speed is the same as the drum with opposite rotatory directions) type developing device was set so that the gap between said photosensitive drum surface and the sleeve surface could be 0.25 mm, and an alternate current of 400 Hz 1000 V and a direct current bias of −150 V was applied therebetween.

Using as a developer a toner comprising 100 parts of Priolite S-5A (styrene-butadiene copolymer produced by Goodyear Chemicals), 60 parts of magnetite and 3 parts of nigrosin spirit, in which 1.0% of a wet process, silica Nipsil ER (produced by Nippon Silica Co.), was added, development was carried out and then powder image was transferred while applying a direct current corona of −7 V on the backside of the recording paper to obtain a copied image. Fixation was conducted by a commercially available plane paper copying machine (trade name, NP-5000, produced by Canon, Inc.). The image obtained was clear with high density and resolution, exhibiting no fog. The number of durable sheets was as high as 30000 and, even under conditions of 35° C. and 85%, the density was high as 1.25 with good transferring efficiency of 85%.

Comparative example 3

A developer was prepared similarly to in Example 8 except for adding no Nipsil ER, and development, transferring and fixation were conducted by means of the same device as used in Example 8. As the result, the image density was low as 0.63 with much fogging to give only inclear images. Under conditions of 35° C. and 85%, the image obtained was impractical with an extremely low density of 0.32.

Example 9

| | |
|---|---|
| AC polyethylene (polyethylene produced by Allied Chemical Co.) | 100 parts |
| Solvent Black 3 | 5 parts |
| EPT-1000 (magnetite produced by Toda Kogyo Co.) | 60 parts |

A toner powder comprising the above materials was prepared and 1 part of Carplex #120 was mixed with the toner to provide a developer. Using this developer, development and transferring were carried out in the same manner as in Example 8, followed by pressure fixing with a pressure roller, to obtain images. The images were clear without fog. When continuous durability test was conducted using this developer, the image after 10000 sheets of copying was substantially the same as the images at the initial stage.

Example 10

| | |
|---|---|
| Polymist A-12 (polyethylene produced by Allied Chemical Co.) | 100 parts |
| Solvent Black 3 | 5 parts |
| Imusil A-108 (wet process silica, Illinois Min. Co.) | 15 parts |
| EPT-1000 (magnetite, produced by Toda Kogyo Co.) | 60 parts |

The above materials were well blended in a blender and then kneaded on a two-roll mill heated at 150° C. After cooling, the mixture was granulated by a cutter mill and pulverized by means of a pulverizer using a jet air stream. The resulting powder were further classified by means of a wind force classfier to obtain a developer with an average particle size of 13μ.

Using this developer, development and transferring were conducted similarly to in Example 8, followed by pressure fixing with a pressure roller. The images were highly clear with no fog, having an image density of 1.30. After durable sheets of 10000, the image density was 1.20, which is substantially the same as the value at the initial stage, and the image was also excellent in resolution.

Example 11

A mixture comprising 100 parts of zinc oxide, 20 parts of styrene-butadiene copolymer, 40 parts of n-butyl methacrylate, 120 parts of toluene and 4 parts of 1% methanolic solution of Rose Bengal was dispersed and mixed in a ball mill for 6 hours. The mixture was coated by a wire bar on an aluminum plate with a thickness of 0.05 mm to a dried coating thickness of 40μ and the solvent was evaporated with hot air to prepare a zinc oxide binder system photosensitive member, which was then formed into a drum-like shape. The entire surface of this photosensitive member was uniformly charged by corona discharge of −6 KV, and thereafter projection of original image was effected thereon to form an electrostatic latent image.

The developer support was a cylindrical sleeve made of stainless steel with an outer diameter of 50 mm. The flux density on the sleeve surface was 700 Gauss and the gap between the ear-cutting blade and the sleeve surface 0.2 mm. This sleeve-rotating magnet-fixed (the sleeve circumferential speed is the same as the drum with opposite rotatory directions) type developing device was set, so that the gap between said photosensitive drum surface and the sleeve surface could be 0.25 mm, and an alternate current of 400 Hz 1000 V and a direct current bias of −150 V was applied therebetween.

| | |
|---|---|
| Polyethylene (PE 130, produced by Hoechst AG) | 100 parts |
| Methylene Blue chloride | 5 parts |
| Magnetite | 60 parts |
| Wet process silica (Nipsil ER, produced by Nippon Silica Co.) | 15 parts |

The above material were thoroughly blended in a blender and thereafter kneaded on a two-roll mile heated at 150° C. After leaving the kneaded product to cool, it was granulated by a cutter mill and further pulverized by a pulverizer using a jet air stream, followed by classification by means of a wind force classifier to obtain fine powders with an average particle diameter of 10 to 20μ.

To the fine powders, 0.1% by weight of the above wet process silica Nipsil ER based on the developer and mixing was carried out in a Henschel mixer to provide a developer. After conducting development similarly to described above, copied image was obtained on a plane paper using electrostatic corona. The image had a high optical reflection density of 1.4 and was clear and high in resolution without fogging. When the image was further applied on a pressure fixing device comprising metal rollers subjected to hard chromium plating, whereby complete fixing was effected. The fixing pressure was 15 kg/cm. Further, using this developer, 10000 sheets of copying were conducted continuously. As the result, the obtained image after copying 10000 sheets was similar in quality to that obtained at the initial stage and very good without deterioration of developer and contamination of the developing sleeve. Next, the environmental characteristics of this developer were examined. When images were obtained under the conditions of 15° C. and relative humidity of 15%, the images were free from fog and image density was 1.30 and substantially the same as that obtained under conditions of normal temperature and normal humidity. Also, under the conditions of 35° C. and a relative humidity of 85%, the image density was sufficiently high as 1.25 and the transferring efficiency was excellently 85%. The images were also excellent in resolution, thus indicating excellent environmental characteristics of this developer.

Example 12

| | |
|---|---|
| Polyethylene (AC polyethylene #6, produced by Allied Chemical Co.) | 100 parts |
| Wet process silica (Carplex #1120, produced by Shionogi & Co., Ltd.) | 20 parts |
| Carbon black | 5 parts |

The above materials were processed in the same manner as in Example 11 to prepare fine powders with an average diameter of 10μ. To the fine powders, there were added 0.6% by weight based on said powders of the above wet system method silica Carplex #1120, and the mixture was further mixed thoroughly with 80 parts of EFV250/400 (iron powders, produced by Nippon Iron Powder Co.) to provide a developer. This developer was applied to a developing device comprising a sleeve having a magnetic pole and magnetic brush development was performed with the use of a latent image prepared on a photosensitive element similarly to in Example 11. After transferring on a plate paper, the copied image was observed to be free from fog and high in resolution, having a high density (image density 1.28). In continuous copying with the use of this developer, the image at the time after 1000 sheets of copying was substantially equal to that at the initial stage. When the environmental characteristics were examined similarly as in Example 11, the image concentration at 15° C., and a relative humidity of 15% was 1.25, while that at 35° C. and a relative humidity of 85% 1.20, thus indicating no change in developing and copying characteristics by the changes in environment.

For the purpose of examining the state of dispersion of carbon black and the wet process method silica in the developer, a slice of the powder was observed by a transmissive electron microscope to find that silica and carbon were dispersed very uniformly.

Comparative example 4

A developer was prepared similarly to in Example 11 except for using no wet process method Silica Nipsil ER at the time of kneading and performing no dry mixing, and development was performed similarly to in Example 11. As the result, there was obtained a very faint reversed image, exhibiting no positive charging characteristic.

Comparative example 5

When preparation of a developer and development were performed similarly to in Example 12, except for adding a dry process silica Aerozil #200 (Nippon Aerozil Co.) in place of the wet process silica Carplex #1120, there was only obtained a very dense reversed image.

What we claim is:

1. A positively charged developer for electrophotography, comprising a toner particle containing a finely divided silicic acid which is prepared by a wet process and has a pH value of 6 to 11 when suspended at a concentration of 4% by weight in distilled water.

2. A developer according to claim 1, wherein the finely divided silicic acid is contained in an amount of 0.01 to 20% by weight based on the weight of the developer.

3. A developer according to claim 1, wherein the finely divided silicic acid contains 85% by weight or more of $SiO_2$.

4. A developer according to claim 1, wherein the finely divided silicic acid contains sodium in an amount of 0.01 to 10% by weight as calculated in terms of $Na_2O$.

5. A developer according to claim 1, wherein the finely divided silicic acid exhibits a weight loss of 0.1 to 10% by weight when heated at 900° C. for 2 hours.

6. A positively charged developer comprising mixture of fine toner particles, containing an ethylenic olefin polymer and a finely divided silicic acid synthesized according to a wet process wherein the finely divided silicic acid has a pH value of 6 to 11 when suspended at a concentration of 4% by weight in distilled water.

7. A positively charged developer for electrophotography, comprising a toner particles and a finely divided silicic acid which is prepared by a wet process and has a pH value of 6 to 11 when suspended at a concentration of 4 percent by weight in distilled water.

8. A developer according to 7, wherein the finely divided silicic acid is contained in an amount of 0.01 to 20% by weight based on the weight of the developer.

9. A developer according to claim 7, wherein the finely divided silicic acid contains 85% by weight or more of $SiO_2$.

10. A developer according to claim 7, wherein the finely divided silicic acid contains sodium in an amount of 0.01 to 10% by weight as calculated in terms of $Na_2O$.

11. A developer according to claim 7, wherein the finely divided silicic acid exhibits a weight loss of 0.1 to 10% by weight when heated to 900° C. for 2 hours.

12. A positively charged one component magnetic developer for electrophotography, comprising a magnetic toner particle containing a finely divided silicic acid which is prepared by wet process and has a pH value of 6 to 11 when suspended at a concentration of 4% by weight in distilled water.

13. A developer according to claim 12, wherein the finely divided silicic acid is contained in an amount of 0.01 to 20% by weight based on the weight of the developer.

14. A developer according to claim 12 wherein the finely divided silicic acid contains 85% by weight or more of $SiO_2$.

15. A developer according to claim 12 wherein the finely divided silicic acid contains sodium in an amount of 0.01 to 10% by weight as calculated in terms of $Na_2O$.

16. A developer according to claim 12, wherein the finely divided silicic acid exhibits a weight loss of 0.1 to 10% by weight when heated at 900° C. for 2 hours.

17. A positively charged two component magnetic developer for electrophotography comprising a magnetic toner particle and a finely divided silicic acid which is prepared by a wet process and has a pH value of 6 to 11 when suspended at a concentration of 4% by weight in distilled water.

18. A developer according to claim 17, wherein the finely divided silicic acid is contained in an amount of 0.01 to 20% by weight based on the weight of the developer.

19. A developer according to claim 17, wherein the finely divided silicic acid contains 85% by weight or more of $SiO_2$.

20. A developer according to claim 17, wherein the finely divided silicic acid contains sodium in an amount of 0.01 to 10% by weight as calculated in terms of $Na_2O$.

21. A developer according to claim 17, wherein the finely divided silicic acid exhibits a weight loss of 0.1 to 10% by weight when heated at 900° C. for 2 hours.

* * * * *